US011614223B2

(12) United States Patent
Haug

(10) Patent No.: US 11,614,223 B2
(45) **Date of Patent: *Mar. 28, 2023**

(54) ILLUMINATION ASSEMBLIES USING MAGNETIC ATTACHMENT AND ACTIVATION

(71) Applicant: James Haug, Leesburg, VA (US)

(72) Inventor: James Haug, Leesburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/452,180

(22) Filed: Oct. 25, 2021

(65) Prior Publication Data

US 2022/0235924 A1 Jul. 28, 2022

Related U.S. Application Data

(63) Continuation of application No. 17/248,384, filed on Jan. 22, 2021, now Pat. No. 11,187,402.

(51) Int. Cl.
*F21V 21/096* (2006.01)
*F21V 33/00* (2006.01)
(Continued)

(52) U.S. Cl.
CPC ..... *F21V 21/0965* (2013.01); *F21K 9/20* (2016.08); *F21V 33/0036* (2013.01); *A47G 2200/08* (2013.01); *F21Y 2115/10* (2016.08)

(58) Field of Classification Search
CPC ..... F21V 29/0965; F21V 29/096; F21V 33/0036; F21V 21/14; F21V 21/145;
(Continued)

(56) References Cited

U.S. PATENT DOCUMENTS 83,341 A 10/1868 Towndrow
85,834 A 1/1869 Leach
(Continued)

FOREIGN PATENT DOCUMENTS

CA 961785 A 1/1975
CA 2700924 A1 4/2009
(Continued)

OTHER PUBLICATIONS

U.S. Appl. No. 17/248,384, filed Jan. 22, 2021, Issued as U.S. Pat. No. 11,187,402.
(Continued)

*Primary Examiner* — Laura K Tso
(74) *Attorney, Agent, or Firm* — Brake Hughes Bellermann LLP

(57) ABSTRACT

In a general aspect, an illumination assembly includes an article including a body having a first magnetic element with at least one electrically conductive surface. The illumination assembly also includes a light assembly including a housing, a second magnetic element, a light source, and a power source. A first terminal of the light source is electrically connected with a first terminal of the power source. The light assembly also includes a first electrical contact disposed on the housing and electrically coupled with a second terminal of the light source. The light assembly also includes a second electrical contact disposed on the housing and electrically coupled with a second terminal of the power source. Magnetically coupling the light assembly with the article, via the first magnetic element and the second magnetic element, electrically couples the first electrical contact with the second electrical contact to energize the light source.

19 Claims, 9 Drawing Sheets

(51) Int. Cl.
*F21K 9/20* (2016.01)
*F21Y 115/10* (2016.01)

(58) Field of Classification Search
CPC . F21K 9/20; F21K 9/238; F21K 9/275; F21K 9/278; A47G 2200/08; A47G 2200/10; A47G 2023/0658; A47G 2019/2238; A47G 23/0309
USPC ..... 362/398, 101, 205, 206, 190, 191; 439/38, 39
See application file for complete search history.

(56) References Cited

U.S. PATENT DOCUMENTS 131,141 A 9/1872 Will
195,337 A 9/1877 Braunstein
800,427 A 3/1898 Jones, Jr.
848,436 A 5/1900 Rider
782,710 A 2/1905 Weller
809,567 A 1/1906 Henckel
919,691 A 4/1909 Cahill
1,986,958 A 1/1935 Cooperstein
2,054,245 A 9/1936 Cummins
2,120,862 A 6/1938 Heller
2,169,426 A 8/1939 Morton
2,171,919 A 9/1939 Dodge
2,177,337 A 10/1939 Stein
2,217,514 A 10/1940 Henry
2,224,319 A 12/1940 Schroyer
2,532,181 A 11/1950 Moore
2,585,445 A 2/1952 Dingeldein
2,663,866 A 12/1953 Simpson
2,664,004 A 12/1953 Forman
2,745,947 A 5/1956 Sanous
2,918,188 A 12/1959 Todd
2,996,208 A 8/1961 Schroeder
3,013,688 A 12/1961 Luning
3,079,037 A 2/1963 Schechter
3,089,605 A 5/1963 Buonauro
3,091,360 A 5/1963 Edward
3,218,447 A 11/1965 Pardue
3,325,048 A 6/1967 Bryant
3,347,411 A 10/1967 Kalata et al.
3,369,687 A 2/1968 Walls
3,374,344 A 3/1968 Rudolph et al.
3,393,819 A 7/1968 De et al.
3,441,173 A 4/1969 Edwards
3,482,731 A 12/1969 Douty
3,526,335 A 9/1970 Swett et al.
3,735,113 A 5/1973 Stott
3,784,052 A 1/1974 Edwards
3,878,386 A 4/1975 Douglas
3,934,725 A 1/1976 Edwards
3,987,930 A 10/1976 Fuson
4,344,113 A 8/1982 Ditto et al.
4,563,726 A 1/1986 Newcomb et al.
4,922,355 A 5/1990 Dietz et al.
5,014,865 A 5/1991 Sauber
5,070,435 A 12/1991 Weller
5,119,279 A 6/1992 Makowsky
5,146,957 A 9/1992 Belokin et al.
5,160,031 A 11/1992 Palisin et al.
5,178,450 A 1/1993 Zelensky et al.
5,211,699 A 5/1993 Tipton
5,287,979 A 2/1994 Bourgeois
5,292,018 A 3/1994 Travisano
5,339,548 A 8/1994 Russell
5,504,663 A 4/1996 Tucker
5,513,764 A 5/1996 Harrison et al.
5,575,553 A 11/1996 Tipton
5,586,647 A 12/1996 Barta et al.
5,609,409 A 3/1997 Diehl
5,624,177 A 4/1997 Rosaia
5,671,998 A 9/1997 Collet
5,785,407 A 7/1998 Ratcliffe et al.
5,842,590 A 12/1998 Gordon et al.
5,879,068 A 3/1999 Menashrov et al.
5,931,558 A 8/1999 Chen
5,996,825 A 12/1999 Gordon et al.
6,062,380 A 5/2000 Dorney
6,065,848 A 5/2000 Tucker et al.
6,092,905 A 7/2000 Koehn
6,163,248 A 12/2000 Paek et al.
6,164,473 A 12/2000 Waldrip
6,213,301 B1 4/2001 Landis et al.
6,213,616 B1 4/2001 Chien
6,302,567 B1 10/2001 Gamble
6,305,656 B1 10/2001 Wemyss
6,352,352 B1 3/2002 Schletterer et al.
6,371,624 B1 4/2002 Dorney
6,409,374 B1 6/2002 Willat
6,416,198 B1 7/2002 Vanderschuit
6,511,197 B1 1/2003 Kalemjian
6,598,991 B2 7/2003 Altman
6,640,989 B2 11/2003 Matsui
6,644,846 B2 11/2003 Willat
6,662,959 B1 12/2003 Westerhold
6,746,132 B2 6/2004 Liu
6,758,058 B1 7/2004 Citrynell et al.
6,955,443 B2 10/2005 Solowiej
D514,387 S 2/2006 Rockwell
7,033,040 B2 4/2006 Spahr et al.
7,416,311 B2 8/2008 Dietz
7,861,888 B2 1/2011 Niedzwiecki
7,976,177 B2 7/2011 Dikopf
8,596,812 B2 12/2013 Yeh
8,829,824 B2 9/2014 Scott
8,915,609 B1 12/2014 Shah et al.
8,939,602 B2 1/2015 Wessel
8,967,824 B2 3/2015 Hootman et al.
9,044,112 B2 6/2015 Lee
9,080,734 B2 7/2015 Andersen et al.
9,086,194 B2 7/2015 Eibner et al.
9,157,573 B1 10/2015 Zach et al.
9,706,803 B2 7/2017 Rapisarda
9,743,696 B1 8/2017 Ramsey
10,098,394 B1 10/2018 Infante
10,123,604 B2 11/2018 Valkenhoff
10,465,887 B1 11/2019 Levy et al.
10,479,555 B2 11/2019 Lee
10,674,619 B1 6/2020 Heffner
10,677,450 B2 6/2020 Matte et al.
10,746,393 B1 8/2020 White et al.
11,187,402 B1 * 11/2021 Haug ..... F21K 9/20
2002/0104819 A1 8/2002 Matsui
2003/0098311 A1 5/2003 Parentini
2004/0001332 A1 1/2004 Solowiej
2004/0017678 A1 1/2004 Liu
2004/0202751 A1 10/2004 McKay et al.
2005/0092759 A1 5/2005 Willat et al.
2005/0139570 A1 6/2005 Lambert et al.
2008/0179328 A1 7/2008 Anderson
2008/0264958 A1 10/2008 Blake
2011/0174763 A1 7/2011 Kennedy
2013/0020333 A1 1/2013 Scott
2013/0163235 A1 6/2013 Chuang
2013/0259984 A1 10/2013 Eves
2013/0334166 A1 12/2013 Garipalli et al.
2014/0054304 A1 2/2014 Hu
2014/0291335 A1 10/2014 Lee
2016/0018070 A1 1/2016 Van Deursen et al.
2016/0146445 A1 5/2016 Shine et al.
2018/0098653 A1 4/2018 Pinchuk
2018/0255949 A1 9/2018 Fritz

FOREIGN PATENT DOCUMENTS

DE 56453 C 4/1891
EP 0012009 A2 6/1980
FR 357416 A 12/1905
FR 531097 A 1/1922
FR 625913 A 8/1927
FR 696970 A 1/1931
FR 385381 A 9/1943

(56) References Cited

FOREIGN PATENT DOCUMENTS

| | | | |
|---|---|---|---|
| FR | 1236001 | A | 7/1960 |
| JP | 2001039445 | A | 2/2001 |
| JP | 3148886 | U | 2/2009 |
| KR | 1020080006233 | | 1/2008 |
| KR | 200455115 | Y1 | 8/2011 |
| RU | 2243446 | C1 | 12/2004 |

OTHER PUBLICATIONS

International Search Report and Written Opinion for PCT Application No. PCT/US2021/072015, dated Mar. 1, 2022, 13 pages.

* cited by examiner

ILLUMINATION ASSEMBLIES USING MAGNETIC ATTACHMENT AND ACTIVATION

CROSS-REFERENCE TO RELATED APPLICATION

This application is a continuation of, and claims priority to, U.S. patent application Ser. No. 17/248,384, filed on Jan. 22, 2021, entitled "ILLUMINATION ASSEMBLIES USING MAGNETIC ATTACHMENT AND ACTIVATION", the disclosure of which is incorporated by reference herein in its entirety.

TECHNICAL FIELD

The present invention relates to apparatuses for illumination of objects such as bottles, jars, receptacles, and/or drinking vessels.

BACKGROUND

Vessels, such as beverageware, stemware, or other vessels with illuminated bases and/or bodies can provide an aesthetic appeal, as well as allow for distinguishing between vessels, such as at a social gathering, and can improve visibility of such a vessel, its contents, and/or an area surrounding the vessel. Current approaches for implementing such illuminated vessels or other objects, include the use of light sources, associated power sources, wires, switches, and electronics that are permanently contained on or within a vessel, use mechanical attachment mechanisms for attaching lighting features (e.g., snap fit, etc.), use mechanical enclosures for containing a light assembly, or use a combination of such elements.

Such current implementations have various drawbacks. For instance, in some implementations elements of such lighting features are permanently embedded in a corresponding vessel, which does not allow for use of such vessels without those embedded features. Further, such approaches can require manufacturing of, or assembly of specialized vessels with structural features that accommodate lights, power sources, electrical connections (e.g., wires), electronics (e.g., circuit boards), switches, or other elements of an associated electrical, lighting circuit. Use of such specialized vessels can add manufacturing and/or material cost and may not allow for replacement or alteration of the lighting features and associated electronics without replacing a portion of, or an entire associated vessel. Furthermore, such permanent lighting elements can be susceptible to damage during normal use of an associated vessel, such as from washing, drying, exposure to liquids, heat, etc., and measures to protect those elements from such damage (e.g., waterproofing) can further increase associated costs of materials and/or manufacturing.

SUMMARY

In a general aspect, an illumination assembly includes an article including a body having a first magnetic element, and at least one electrically conductive surface. The assembly also includes a light assembly including a housing, a second magnetic element, a light source, and a power source. A first terminal of the light source is electrically connected with a first terminal of the power source. The assembly also includes a first electrical contact disposed on the housing, where the first electrical contact is electrically coupled with a second terminal of the light source. The assembly also includes a second electrical contact disposed on the housing, the second electrical contact being electrically coupled with a second terminal of the power source. Magnetically coupling the light assembly with the article, via the first magnetic element and the second magnetic element, electrically couples the first electrical contact with the second electrical contact, via the at least one conductive surface of the article, to energize the light source.

Figure 1:
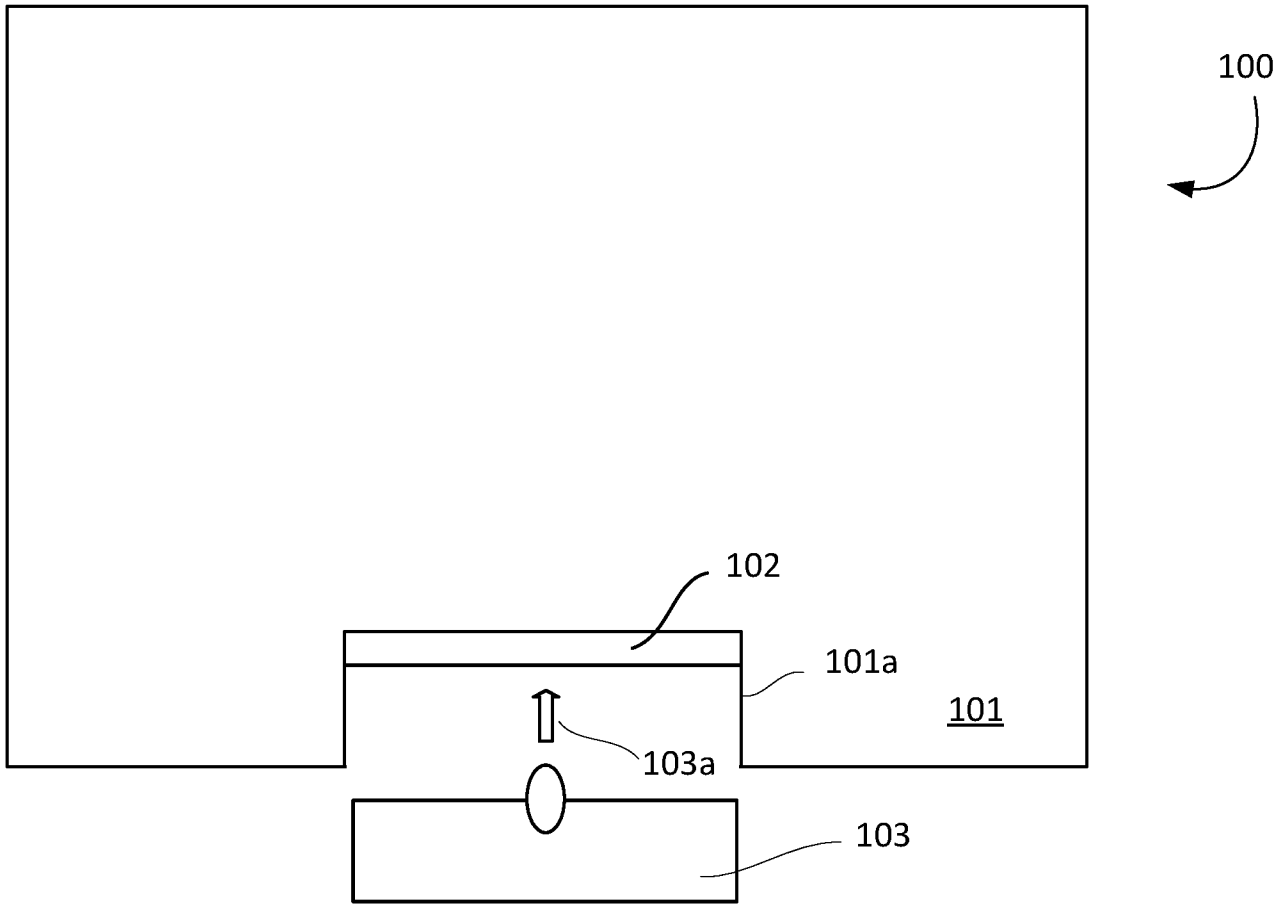
FIG. 1 is a diagram schematically illustrating an illumination assembly.

In the drawings, which may not necessarily be to scale, reference numbers for like or similar elements may not be shown for each of those elements. Also, reference numbers from one view of a given implementation may be not be repeated in the related views. Further, in some instances, for purposes of comparing different views, reference numbers from one view of a given implementation may be repeated in other views, but may not be specifically discussed with respect to each view.

DETAILED DESCRIPTION

Detailed embodiments are disclosed herein. However, it is understood that the disclosed embodiments are merely examples, which may be embodied in various forms. Therefore, specific structural and functional details disclosed herein are not to be interpreted as limiting, but merely as a basis for the claims and as a representative basis for teaching one skilled in the art to variously employ the embodiments in virtually any appropriately detailed structure. Further, the terms and phrases used herein are not intended to be limiting, but to provide an understandable description of the present disclosure.

The terms "a" or "an," as used herein, are defined as one or more than one. The term "another," as used herein, is defined as at least a second or more. The terms "including" and/or "having", as used herein, are defined as comprising (i.e., open transition). The term "coupled" or "moveably coupled," as used herein, is defined as connected, although not necessarily directly and mechanically.

This disclosure is directed to approaches for implementing illuminated objects (illumination assemblies) that include the use of a separable light assembly, which can eliminate at least some of the drawbacks of current approaches noted above. In the implementations disclosed herein, magnetic connections are used to attach and activate (turn on, energize, selectively energize) a light source included in the light assembly. Such use of a magnetic connection to attach a light assembly to a vessel, and to control operation of an associated light source and electrical circuit, can reduce a number of electrical and attachment features used to implement a light assembly and an object, article, or vessel that is illuminated with the light assembly. Accordingly, such approaches eliminate permanently included, or permanently embedded elements for providing illumination. For instance, such approaches can eliminate the need for use of a separate electrical switch to control a light source, which can, in turn, reduce a space or volume used for a light assembly and associated attachment features as compared to current approaches.

The example implementations described herein can also allow for illumination of vessels and/or objects with limited space for incorporating or attaching a light assembly. For example, traditional wineglasses typically have a thin flat base that quickly transitions to a narrow stem. Such vessels, therefore, provide limited space to incorporate a light assembly, e.g., on a bottom of the base. While increasing a size of the base may allow for inclusion of a light assembly, such an increase in base size could detract from aesthetics of the vessel. The approaches described herein, due to reduced size of the disclosed light assemblies, as compared to current lighting feature and circuits, allow for incorporation of those light assemblies with vessels having such limited space, without impacting design of, or aesthetics of the vessel, with or without the light assembly included. Further, the approaches described herein also allow for a proportion of total space, or volume of a light assembly allocated for an associated power source, such as a battery, to be increased as compared to prior approaches, which can increase an amount of time between recharging or replacement of the power source.

In the disclosed implementations, use of magnetic connections allows for quick attachment and removal of a light assembly with an object, without the need to snap, twist, push connections together, and/or pull connections apart. This ease of connection and disconnection can reduce potential mishandling of, and risk of accidentally breaking or damaging the object, or light assembly, when removing or attaching the light assembly, from or to an associated object. The use of magnetic connections also facilitates easy separation, or removal, of a light assembly if an associated object is to be cleaned, or placed in an environment that is otherwise detrimental to electrical components, such as a dishwasher. Further, ease of connection and disconnection using magnetic couplings can also improve user experience, such as for users with limited mobility or dexterity of their hands or fingers. The ease of magnetic connections and disconnections can also allow users to easily attach, change, or remove light assemblies while an associated object, such as a drinking glass, is being used.

Use of magnetic connections, as described herein, can also allow a user to rotate a light assembly relative to an associated object, when the light assembly and object are magnetically coupled with each other. In some implementations, based on configuration of electrical connections contained in a light assembly, and/or configuration of one or more electrically conductive surfaces included on an associated object, such rotation of a light assembly can control operation of a light source included in the light assembly. For example, rotating the light assembly relative to an associated object can selectively turn the light source on or off, without use of a separate switch. In such implementations, a light assembly can remain attached to an associated object with the associated light source turned off (deenergized), which can allow for easy storage of the light assembly with the object or vessel, and can also reduce a likelihood of the light assembly being misplaced.

Further, in the implementations described herein, use of magnetic connections to attach and activate a light source to illuminate an associated object can be accomplished using a magnet or magnetically-attractive material that is attached to the object. Accordingly, manufacturing of specialty features integral to the object, or producing a custom vessel can be avoided, which can reduce assembly and manufacturing costs as compared to current approaches. Further, use of magnetic connections, as described herein, can allow for the illumination of objects that include fragile materials, such as glass. It is noted that, while the implementations described herein are generally discussed in the context of drinking vessels, or other objects that are configured to hold or house a fluid or other substance, the illumination assemblies described can implemented in association with objects having other forms.

FIG. 1 is a diagram that schematically illustrates an illumination assembly 100. As shown in FIG. 1, the illumination assembly 100 includes an article having a body 101 and a magnetic element 102, which can include a magnet and/or a magnetically-attractive material. As noted above, the body 101 can take a number of appropriate forms, such as an illumination fixture, a drinking vessel, a decorative object, etc.

In this example, the magnetic element 102 is disposed in an opening 101*a* of the body 101. In some implementations, the opening 101*a* can be a recess, an open space, or a contour. Depending on the particular implementation, the magnetic element 102 can be coupled to the body 101, embedded in the body 101, or included in a magnetic assembly that is coupled to the body 101. In some implementations, the magnetic element 102 can be coupled with the body 101 using an adhesive connection, a press-fit connection, a frictional connection, or an interference connection.

As shown by the arrow 103*a* in FIG. 1, the opening 101*a* can be configured to receive a light assembly 103, which can include another magnetic element, such as a magnet or magnetically-attractive material, that can form a magnetic connection with the magnetic element 102. As described herein, such a magnetic connection between the magnetic element 102 and the light assembly 103 can magnetically couple the light assembly 103 with the body 101, as well as energize a light source included in the light assembly 103 to illuminate, at least a portion of, the body 101. In some implementations the light source can include a light emitting diode (LED).

Figures 2A, 2B, 2C, 2D:
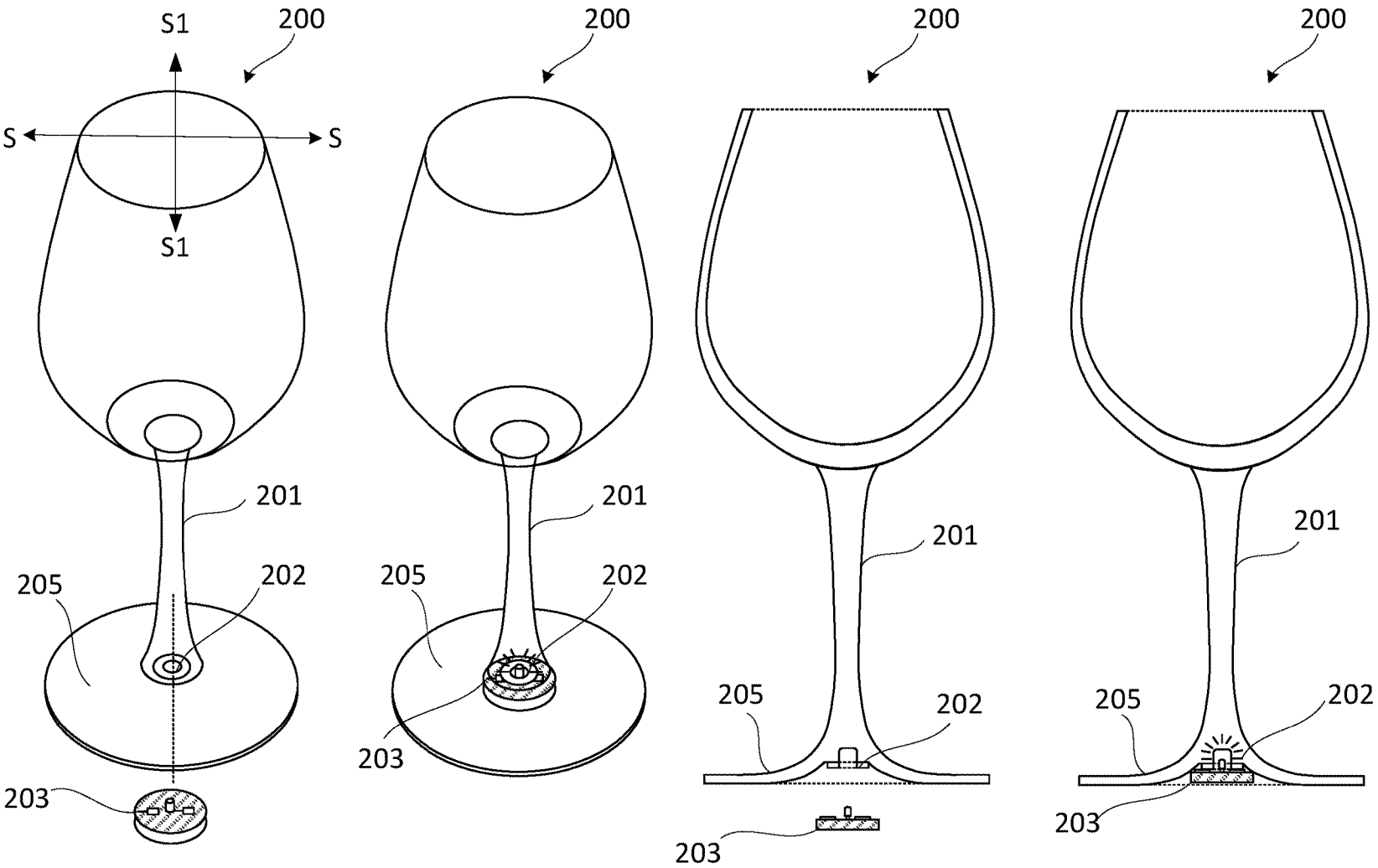
FIGS. 2A-2D are diagrams illustrating various views of an illumination assembly in the form of a stemware vessel.

FIGS. 2A-2D are diagrams illustrating various views of an illumination assembly 200 in the form of a stemware vessel 201, such as a wineglass. Specifically, FIG. 2A is a diagram illustrating a perspective view of the illumination assembly 200 with a light assembly 203 shown separate from the stemware vessel 201. FIG. 2B is a diagram illustrating a perspective view of the stemware vessel 201 with the light assembly 203 attached to a foot 205 of the stemware vessel 201, and a light source of the light assembly 203 energized. FIG. 2C is a diagram, corresponding with FIG. 2A, that illustrates a cross-sectional view of the illumination assembly 200, along a plane defined by the lines S-S and S1-S1 in FIG. 2A, with the light assembly 203 separate from the stemware vessel 201. FIG. 2D is a diagram that illustrates a cross-sectional view of the illumination assembly 200 along the plane of FIG. 2A, e.g., with the light assembly 203 magnetically attached to the stemware vessel 201, and the light source of the light assembly 203 energized. For purposes of this disclosure, the various cross-sectional views illustrated and described herein can be similarly taken along a plane as defined in FIG. 2A, and such plane is not shown for each example implementation.

In the example implementation of FIGS. 2A-2D, the stemware vessel 201 has a magnetic element 202, which can include a magnet or magnetically-attractive material, such as a metal, that can be attached to a bottom surface of the foot 205 using an appropriate attachment connection. In some implementations, the magnetic element 202 can be embedded within the stemware vessel 201, e.g., within the foot 205. In some implementations, the stemware vessel 201, or a portion of the stemware vessel 201, such as the foot 205, or a base including the foot 205, can be made from a magnetic or magnetically-attractive material, and the magnetic element 202 could be eliminated.

In the illumination assembly 200 of FIGS. 2A-2D, the light assembly 203 can also contain a magnetic element, which can form a magnetic connection with the magnetic element 202 that is attached to, or included in the stemware vessel 201. This magnetic connection can magnetically couple the light assembly 203 with the stemware vessel 201, such as shown in FIGS. 2B and 2D. The connection (magnetic and/or physical connection resulting from the magnetic coupling) of the light assembly 203 with the magnetic element 202 on the stemware vessel 201 can also complete, using the approaches described herein, an electrical circuit to energize the light source of the light assembly 203. The light assembly 203 can then provide illumination of, at least a portion of, the stemware vessel 201, and/or of an area surrounding the stemware vessel 201. Again, while FIGS. 2A-2D illustrate the illumination assembly 200 in the form of stemware vessel 201, an object being illuminated in an illumination assembly can take other forms.

Figure 3A:
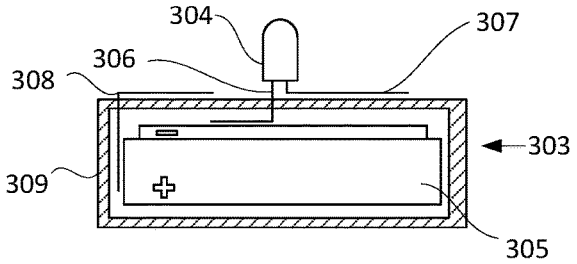
FIGS. 3A-3F are diagrams illustrating various views of a light assembly and magnetic element that can be implemented in an illumination assembly, such those of FIGS. 1 and 2A-2D.
Figure 3D:
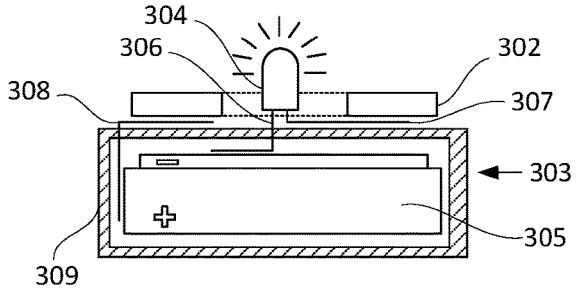
Figure 3B:
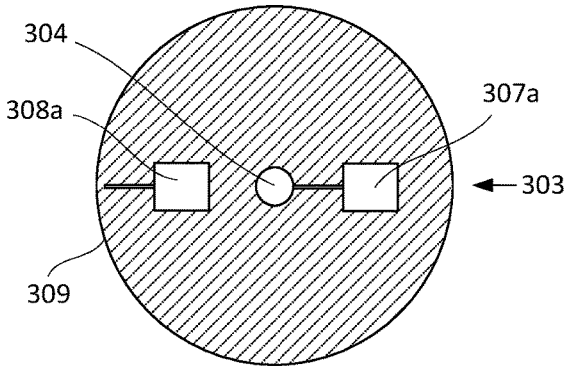
Figure 3E:
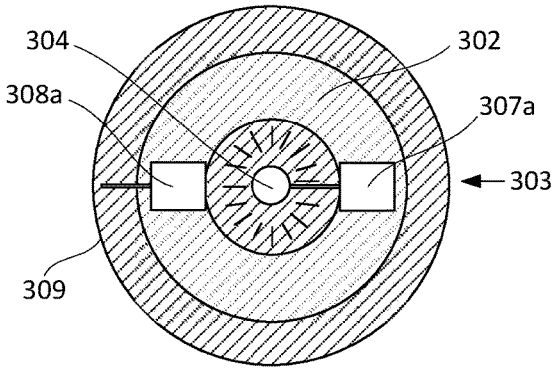
Figure 3C:
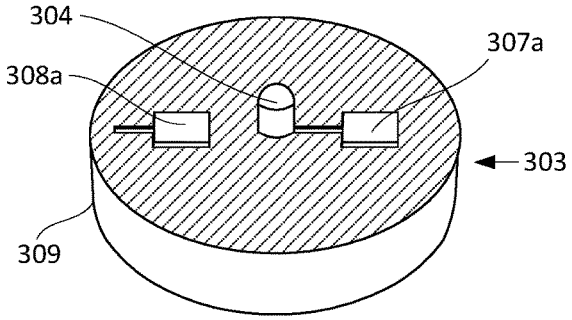
Figure 3F:
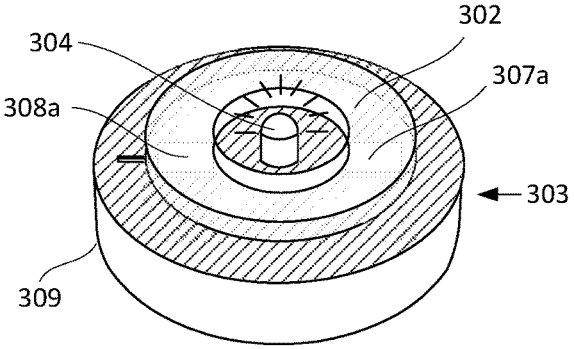

FIGS. 3A-3F are diagrams illustrating various views of a light assembly 303 and a corresponding magnetic element 302 that can be implemented in an illumination assembly, such those of FIGS. 1 and 2A-2D. Specifically, FIGS. 3A-3C are diagrams that illustrate, respectively, a cross-sectional view taken along a plane (such as the plane of FIG. 2A), a top view, and a perspective view of the light assembly 303 that is detached from a corresponding electrically conductive and magnetic element. FIGS. 3D-3F are diagrams that illustrate, respectively, a cross-sectional view (e.g., along the plane of FIG. 2A), a top view, and a perspective view of the light assembly 303 with a magnetic element 302 attached.

As shown in FIGS. 3A-3F, the light assembly 303 includes a light source 304, which can be a LED, and a power source 305, which can include a battery, a capacitor and/or other devices. As shown in FIG. 3A, a first terminal 306 of the light source 304, which can be an electrical terminal, or an electrical lead, is electrically connected to a first terminal (a negative battery terminal in this example) of the power source 305, while a second terminal 307 of the light source 304 is routed to an outer surface of a housing 309 of the light assembly 303, and includes an electrical contact surface 307*a* on the housing 309, such as shown in FIGS. 3B and 3C.

Also in the light assembly 303, an electrical terminal 308, which can include an electrical terminal, an electrical contact, and/or an electrical trace, is electrically coupled with a second terminal of the power source 305 (a positive battery terminal in this example). As shown in FIG. 3A, and further illustrated in FIGS. 3B and 3C, the electrical terminal 308 is also routed to an outer surface of the housing 309, and includes an electrical contact surface 308*a* that is similar to the electrical contact surface 307*a* associated with the second terminal 307 of the light source 304.

As shown in FIGS. 3D-3F, as a result of the light assembly 303 being magnetically connected or coupled with the magnetic element 302, the electrical contact surface 307*a* and the electrical contact surface 308*a* on the surface of the housing 309 (which are under the magnetic element 302 in FIGS. 3E and 3F) are electrically coupled to each other, via the magnetic element 302, to complete the circuit of the light assembly 303 and energize the light source 304.

Figure 4A:
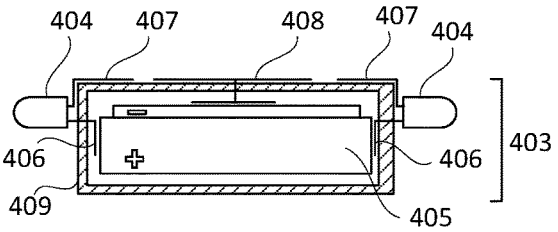
FIGS. 4A-4I are diagrams illustrating various views of another light assembly and associated magnetic elements that can be implemented in an illumination assembly, such those of FIGS. 1 and 2A-2D.
Figure 4D:
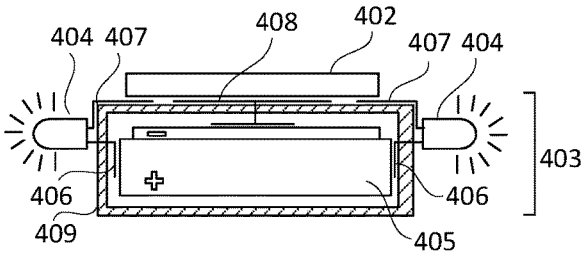
Figure 4B:
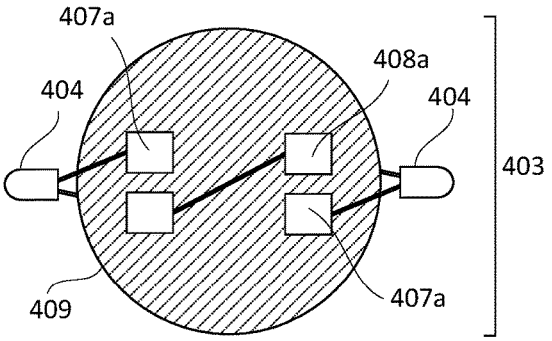
Figure 4E:
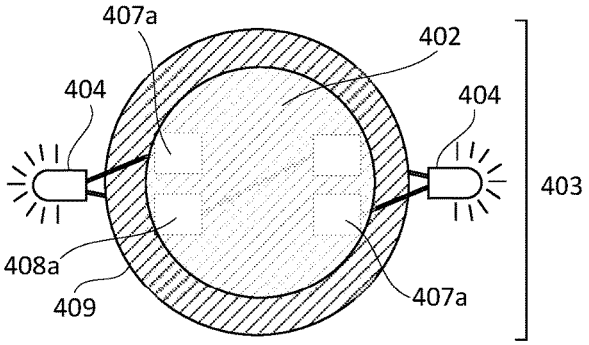
Figure 4C:
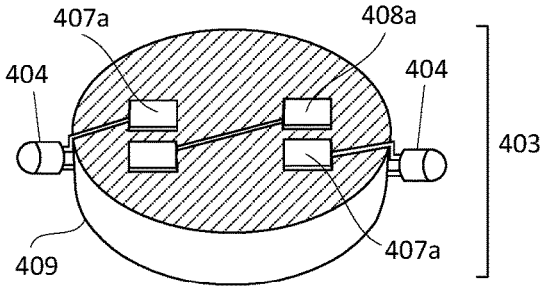
Figure 4F:
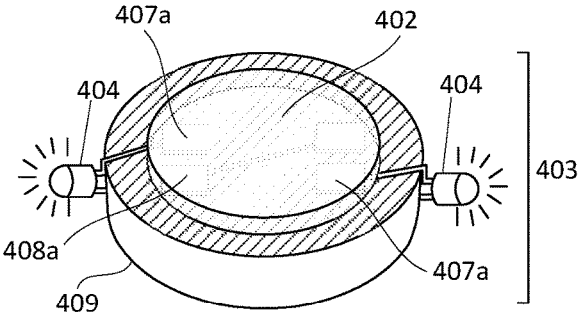
Figure 4G:
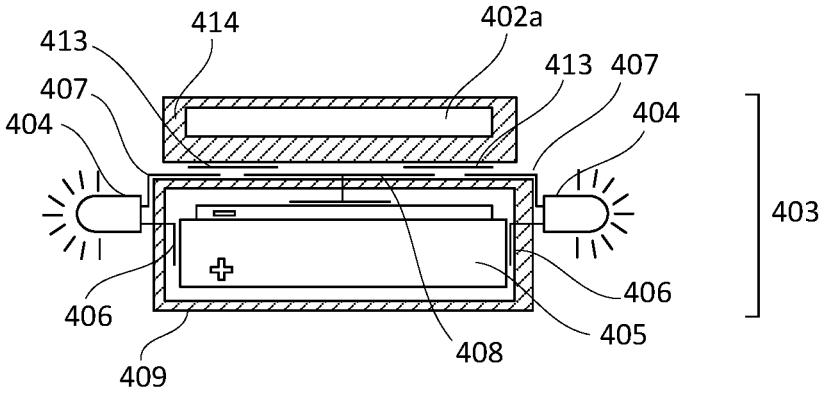
Figure 4H:
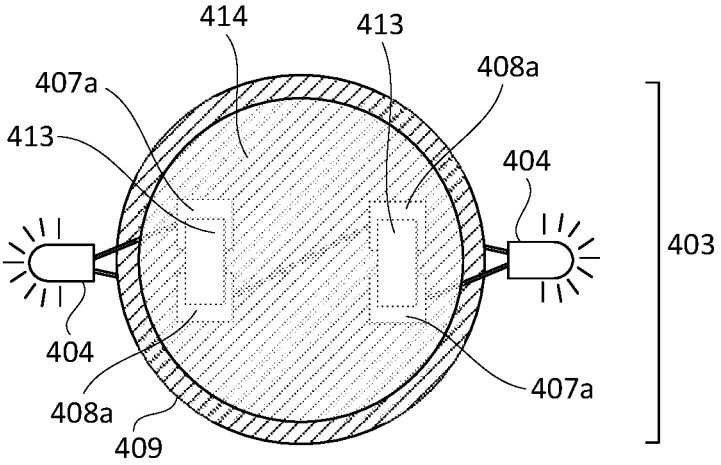
Figure 4I:
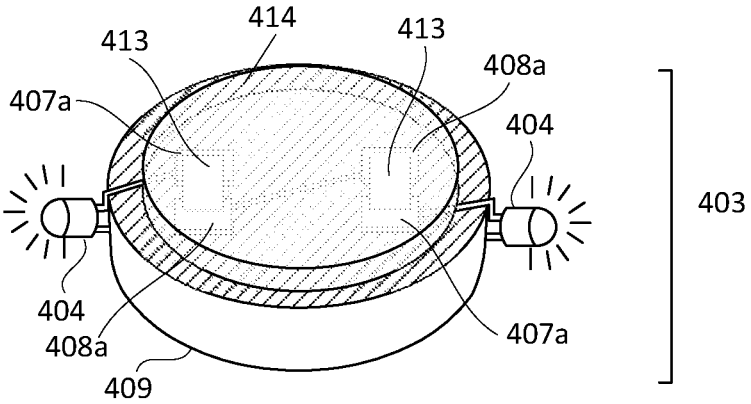

While, in the example implementation of FIGS. 3A-3F, the electrical contact surface 307*a* and the electrical contact surface 308*a* are in direct contact with the magnetic element 302, e.g., to complete the circuit of the light assembly 303, in some implementations, the electrical contact surface 307*a* and the electrical contact surface 308*a*, or the second terminal 307 of the light source 304 and the electrical terminal 308 can come into contact with (directly in contact with) one or more electrically conductive surfaces that are included on, or embedded in an associated object of a corresponding illumination assembly, e.g., as shown in example of FIGS. 4G-4I. Such conductive surfaces can be separate from an associated magnetic element.

The magnetic element 302 and the light assembly 303, as well as the other light assembly implementations described herein, are illustrated as having circular or cylindrical geometries, with the magnetic element 302 being ring shaped with the light source 304 extending, at least partially, through an opening in the magnetic element 302. In some implementations, other geometries or shapes can be used for the light assembly light assembly 303 and the magnetic element 302. For instance, geometry, orientation, and/or positioning of the electrical contact surface 307*a* and the electrical contact surface 308*a* on the housing 309 of the light assembly 303 can vary based on the specific implementation, as can similar elements in other example implementations described herein.

Also, in the example implementation of FIGS. 3A-3F, as well as the other example implementations described herein, because the light assembly 303 is separable from a body of a corresponding illumination assembly, different light assemblies with different light colors, patterns, or other ornamental features can be attached. Such ornamental features can allow a user to customize and distinguish an illuminated object for different occasions. Further, the magnetic element 302, on an associated body of an illumination assembly, can also be used to attach other, non-lighted, ornamental elements or accessories.

FIGS. 4A-4I are diagrams illustrating various views of a light assembly 403 and associated magnetic elements, including magnetic element 402, e.g., in FIGS. 4D-4E, and magnetic element 402*a*, e.g., in FIG. 4G. The light assembly 403 can be implemented in an illumination assembly, such those of FIGS. 1 and 2A-2D. Specifically, FIGS. 4A-4C are diagrams that illustrate, respectively, a cross-sectional view, a top view, and a perspective view of the light assembly 403.

FIGS. 4D-4F are diagrams illustrating, respectively, a cross-sectional view, a top view, and a perspective view, where the light assembly 403 is coupled with the magnetic element 402. FIGS. 4G-4I are diagrams illustrating, respectively, a cross-sectional view, a top view, and a perspective view of the light assembly 403, where the light assembly 403 is coupled with the magnetic element 402*a* and one or more separate conductive surfaces (conductive surfaces 413) that are implemented on a surface of an object of a corresponding illumination assembly.

In the example implementations of FIGS. 4A-4I, the light assembly 403 includes multiple light sources 404. In this example, the multiple light sources 404 are electrically coupled in parallel with one another and, while shown in an example physical arrangement in the light assembly 403, in some implementations, the multiple light sources 404 could be arranged differently than shown in FIGS. 4A-4I. While two light sources 404 are shown in this example, in some implementations, additional light sources could be included. For instance, in an example implementation, a lighting assembly could include a red light source, a blue light source and a green light source, which could allow for producing different illumination colors with different combinations of the light sources. For example, using approaches such as those illustrated in FIGS. 9A-10D, rotating such a lighting assembly could selectively energize or deenergize the corresponding light sources to produce different illumination colors. In other implementations, different numbers of lights could be included.

Referring to FIG. 4A, respective first terminals 406 of the multiple light sources 404 are electrically connected to a first terminal of a power source 405 (a positive battery terminal in this example), while respective second terminals 407 of the multiple light sources 404 are routed to a surface of a housing 409 of the light assembly 403, which include corresponding electrical contact surfaces 407*a* on the housing 409, such as shown in FIGS. 4B and 4C.

Also in the light assembly 403, an electrical terminal 408 is electrically coupled with a second terminal of the power source 405 (a negative battery terminal in this example). As shown in FIG. 4A, and further illustrated in FIGS. 4B and 4C, the electrical terminal 408 is also routed to an outer surface of the housing 409, and includes one or more electrical contact surfaces 408*a*.

As shown in FIGS. 4D-4F, as a result of the light assembly 403 being magnetically connected or coupled with the magnetic element 402, the electrical contact surfaces 407*a* and the electrical contact surface 408*a* on the surface of the housing 409 (which are under the magnetic element 402 in FIGS. 4E and 4F) are electrically coupled to each other, e.g., via the magnetic element 402, to complete the circuit of the light assembly 403 and energize the light sources 404.

As shown in FIGS. 4G-4I, the light assembly 403 can be magnetically coupled with a body 414, where the magnetic element 402*a* used to magnetically couple the light assembly 403 with the body 414 is disposed within the body 414. One or more conductive surfaces 413, or electrical contact surfaces, are disposed on a surface of the body 414. The conductive surfaces 413 are separate (physically separate, electrically separate) from the magnetic element 402*a*. In the example implementations of FIGS. 4G-4I, as a result of the light assembly 403 being magnetically coupled to the body 414 by the magnetic element 402*a*, the electrical circuit of the light assembly 403 is closed, energizing the multiple light sources 404. In this example, the electrical circuit is closed as a result of the corresponding electrical contact surfaces 407*a* and one or more electrical contact surfaces 408*a* being electrically coupled via the conductive surfaces 413.

FIGS. 5-8B are diagrams illustrating various views of light assemblies that can be implemented in an illumination assembly, such those of FIGS. 1 and 2A-2D. The light assembles of FIGS. 5-8B are variations of the light assembly 203. That is, in some implementations, the light assemblies of FIGS. 5-8B can be implemented by modifying the light assembly 203, such as discussed below.

Figure 5:
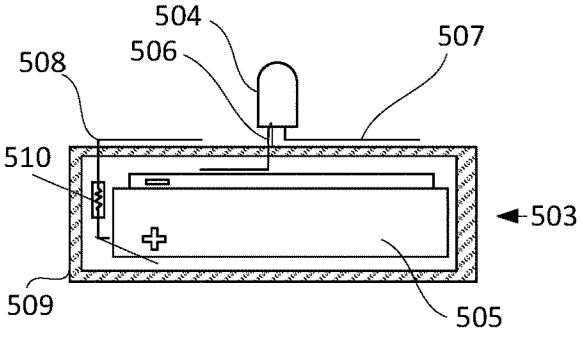

For instance, FIG. 5 is a diagram illustrating a cross-sectional view of a light assembly 503 that includes a light source 504, a power source 505, a first terminal 506 of the light source 504, a second terminal 507 of the light source 504, an electrical connection 508 and a housing 509, which are arranged in similar fashion as the like elements of light assembly 203. As compared to the light assembly light assembly 203, the light assembly 503 includes a resistor 510 that is included in the electrical connection 508, where the resistor 510 can limit current of the circuit of the light assembly 503. While FIG. 5 illustrates the resistor 510 in the light assembly 503, in some implementations, other circuit elements, such as capacitors, inductors, etc., could be included in electrical circuit of the light assembly 503, e.g., to adjust the voltage, current, and power draw of the circuit.

Figure 6:
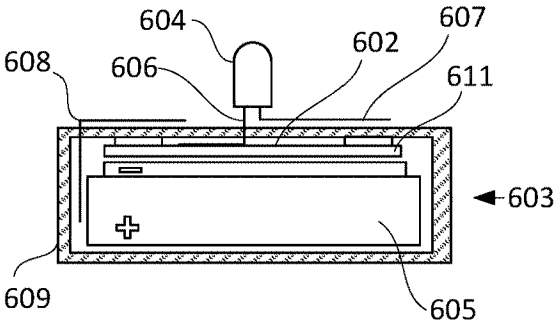

FIG. 6 is a diagram illustrating a cross-sectional view of a light assembly 603 with a magnetic element 602 incorporated within the light assembly 603. As shown in FIG. 6, the light assembly 603 includes a light source 604, a power source 605, a first terminal 606 of the light source 604, a second terminal 607 of the light source 604, an electrical connection 608 and a housing 609, which are arranged in similar fashion as the like elements of light assembly 203. As compared to the light assembly light assembly 203, the light assembly 603 includes a separate magnetic element 611, which can be used to form a magnetic connection with a magnetic element included in a body of a corresponding illumination assembly (e.g., the magnetic element 202 of the stemware vessel 201). The separate magnetic element 611, in this example implementation, can be electrically conductive and, as shown in FIG. 6, can provide, or be included in, an electrical connection between the first terminal 606 of the light source 604 and a terminal of the power source 605 (a negative battery terminal in this example).

In some implementations a light assembly housing, such as the housing 609, can include a magnetic element that can be used to from a magnetic connection with a magnetic element included in, or disposed on a body of a corresponding illumination assembly, such as the magnetic element 202 of the illumination assembly 200. Such an arrangement can eliminate the use of a separate magnetic element, such as the separate magnetic element 611 of the light assembly 603. Also, a power source of a light assembly, e.g., a battery, can contain magnetically-attractive material to form a magnetic connection with a magnetic element included in or disposed on a body of a corresponding illumination assembly. For example, common power sources, such as CR2032 batteries, can include a metal housing that is magnetically attractive, and can be used to form a magnetic connection with a magnetic element included in or disposed on a body of a corresponding illumination assembly, e.g., without including additional magnetic or magnetically-attractive material in a corresponding light assembly.

Figure 7A:
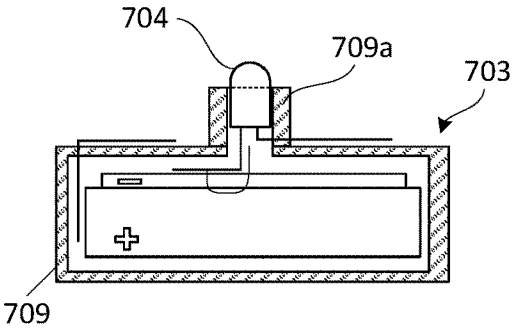
Figure 7B:
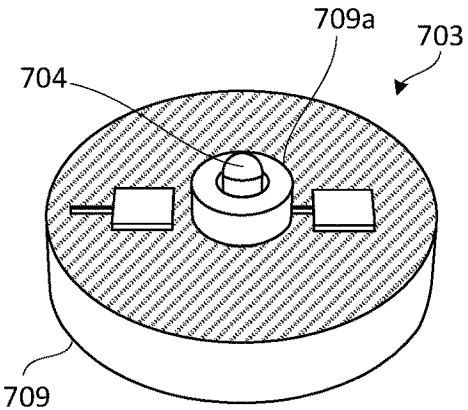

FIGS. 7A and 7B are diagrams illustrating, respectively, a cross-sectional view, and a perspective view of a light assembly 703 that includes a light source 704 and a housing 709, which are arranged in similar fashion as the like elements of light assembly 203. As compared to the light assembly light assembly 203, the housing 709 of the light assembly 703 includes a partial enclosure 709*a* of the light source 704. The partial enclosure 709*a* and/or other portions of the housing 709, in some implementations, can be made of transparent or translucent materials, such as plastic or glass, to allow light from the light source 704 to travel through the housing 709. In some implementations, the light assembly 703, such as in the partial enclosure 709*a*, may also contain reflective elements or coatings that are integral to the housing 709, or attached to the light assembly 703 as separate elements, which can be configured to direct the light from the light source 704 in particular directions. Such features, e.g., as shown in FIGS. 7A and 7B, can also be included in other example light assemblies described herein.

Figure 8A:
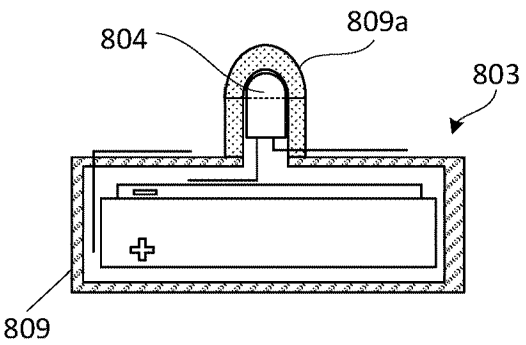
FIGS. 5-8B are diagrams illustrating various views of light assemblies that can be implemented in an illumination assembly, such those of FIGS. 1 and 2A-2D.
Figure 8B:
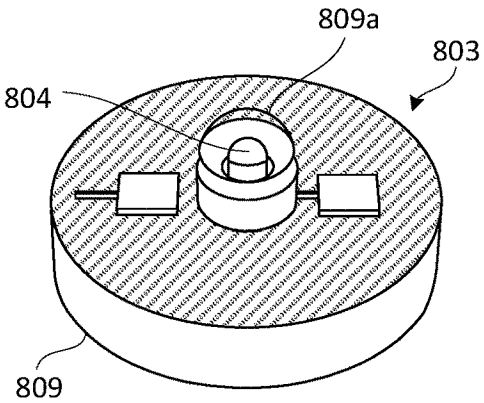

FIGS. 8A and 8B are diagrams illustrating, respectively, a cross-sectional view, and a perspective view of a light assembly 803 that includes a light source 804 and a housing 809, which are arranged in similar fashion as the like elements of light assembly 203. As compared to the light assembly light assembly 203, the housing 809 of the light assembly 803 includes a complete enclosure 809*a* of the light source 804. The enclosure 809*a* and/or other portions of the housing 809, in some implementations, can be made of transparent or translucent materials, such as plastic or glass, to allow light from the light source 804 to travel through the housing 809 of light assembly 803. In some implementations, the light assembly 803, such as the enclosure 809*a*, may also contain reflective elements or coatings that are integral to the housing 809, or attached to the light assembly 803 as separate elements. These reflective elements or coatings can be configured to direct light from the light source 804 in particular directions. Such features, e.g., as shown in FIGS. 8A and 8B, can also be included in other example light assemblies described herein.

Figure 9B:
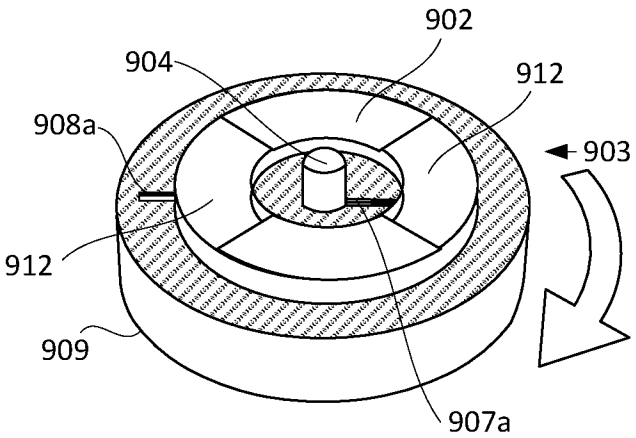
FIGS. 9A-9B are diagrams illustrating various views of a light assembly and a magnetic element that allow for selective energizing and deenergizing of a corresponding light source.
Figure 9A:
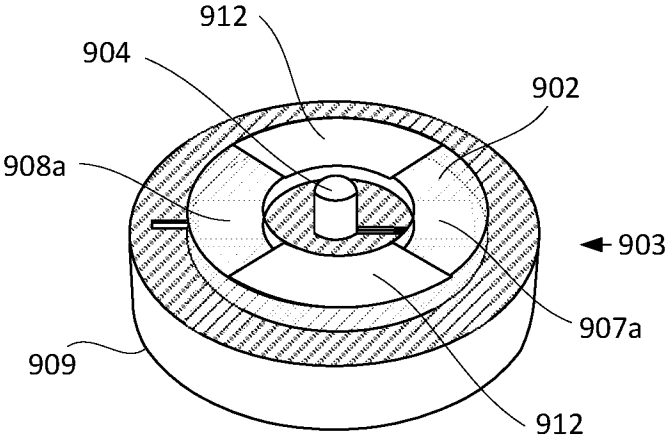

FIGS. 9A-9B are diagrams illustrating various views of a light assembly 903, which is similar to the light assembly 203, and a magnetic element 902 (which can be included in a body of a corresponding illumination assembly) that allows for selective energizing and deenergizing of a corresponding light source 904, e.g., by rotating the light assembly 903 with respect to the magnetic element 902 and its corresponding body. Specifically, FIG. 9A is a perspective view of the light assembly 903 with its electrical contact surfaces being in contact with (e.g., direct contact with) conductive portions of the magnetic element 902. FIG. 9B is a perspective view of the light assembly 903 with its electrical contact surfaces being in contact with (e.g., direct contact with) non-conductive portions 912 of the magnetic element 902.

In the example implementation of FIGS. 9A and 9B, the light assembly 903 includes a light source 904, a contact surface 907*a* disposed on a housing 909 (under the magnetic element 902), and an electrical contact surface 908*a* (also under the magnetic element 902) disposed on the housing 909, which are arranged in similar fashion as the like elements of light assembly 203. Also shown in FIG. 9B, the magnetic element 902 can have electrically non-conductive portions 912, which can be achieved by coating or covering portions of the magnetic element 902 with a non-conductive material or paint.

In this example, when the light assembly 903 is rotated, e.g., with respect to the magnetic element 902 and a corresponding body of an illumination apparatus, such that one, or both of the electrical contact surfaces 907*a* and 908*a* are in direct contact with the non-conductive portions 912 of the magnetic element 902, the electrical circuit of the light assembly 903 would be broken and the light source 904 would be deenergized. Further, when the light assembly light assembly 903 is rotated, such that the electrical contact surfaces 907*a* and 908*a* are both in direct contact with electrically conductive portions of the magnetic element 902, the light source 904 is energized.

Figure 10A:
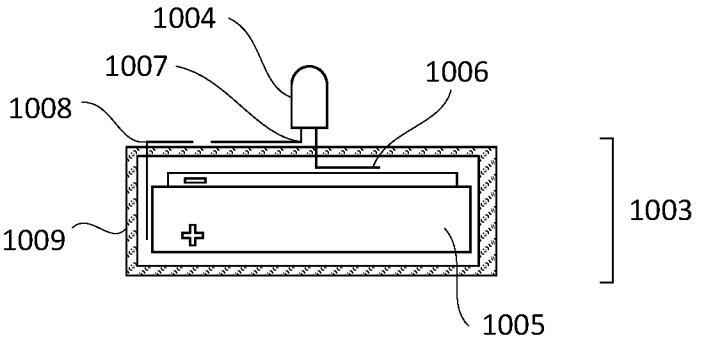
FIGS. 10A-10D are diagrams illustrating various views of another light assembly and magnetic elements that allow for selective energizing and deenergizing of a corresponding light source.
Figure 10B:
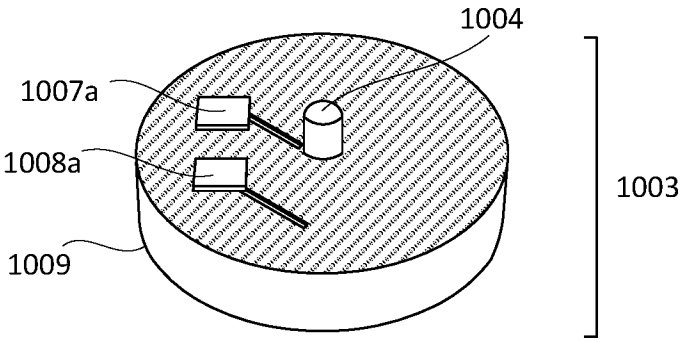
Figure 10C:
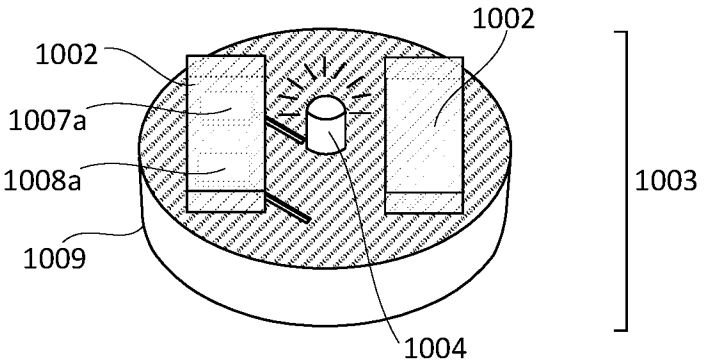
Figure 10D:
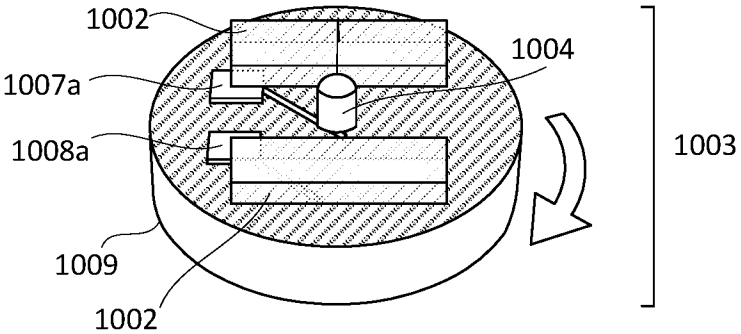

FIGS. 10A-10D are diagrams illustrating various views of another light assembly and magnetic elements that allows for selective energizing and deenergizing of a corresponding light source by rotating a light assembly with respect to a body of a corresponding illumination apparatus. Specifically, FIGS. 10A and 10B are diagrams illustrating, respectively, a cross-sectional view and a perspective view of a light assembly 1003, that is detached from an element of a body of a corresponding illumination apparatus. FIG. 10C is a perspective view of the light assembly 1003 with electrical contact surfaces touching (in direct contact with) a same electrically conductive and magnetic element of the magnetic elements 1002, e.g., electrically coupled with each other. FIG. 10D is a perspective view of the light assembly 1003 with electrical contact surfaces respectively touching (in direct contact with) separate electrically conductive and magnetic elements of the magnetic elements 1002, e.g., not electrically coupled with each other.

As illustrated in FIGS. 10A-10D, the light assembly 1003 includes a light source 1004, a power source 1005, a first terminal 1006, such as an electrical terminal, or an electrical lead of the light source 1004 that is electrically connected to a first terminal of the power source 1005 (a negative battery terminal in this example), while a second terminal 1007 of the light source 1004 is routed to an outer surface of a housing 1009 of the light assembly 1003, which includes an electrical contact surface 1007*a* on the housing 1009, such as shown in FIG. 10B. Also in the light assembly 1003, an electrical terminal 1008, which can include an electrical connection, an electrical contact, or an electrical trace, is electrically coupled with a second terminal of the power source 1005 (a positive battery terminal in this example). As shown in FIG. 10A, and further illustrated in FIG. 10B, the electrical terminal 1008 is also routed to an outer surface of the housing 1009, and includes an electrical contact surface 1008*a* that is similar to the electrical contact surface 1007*a* associated with the second terminal 1007 of the light source 1004.

As shown in FIG. 10C-10D, the magnetic elements 1002 can be shaped such that the electrical contact surfaces 1007*a* and 1008*a* of the light assembly 1003 form an electrical connection in a first orientation, such as shown in FIG. 10B, and do not form an electrical connection when the light assembly 1003 is rotated to a second orientation, such as shown in FIG. 10B. While FIGS. 10A-10D illustrate one implementation of electrical contact surfaces 1007*a* and 1008*a*, and magnetic elements 1002, having two separate rectangular elements, multiple geometries, positioning, and other arrangements of such elements are possible. Further, the electrical contact surfaces 1007*a* and 1008*a*, in some implementations, can vary in number, positioning, and geometry. These various geometries and elements can be used to turn on and off different lights (when multiple light sources are included) based on a rotational orientation of a light assembly relative to a corresponding magnetic element or elements.

For instance, in some implementations, a body of an associated illumination assembly can include electrically conductive surfaces that are separate from a magnetic element included in the body, such as conductive surfaces 413. Such electrically conductive surfaces can align with corresponding electrical contact surfaces of a light assembly, e.g., to complete a circuit of the light assembly, and energize an included light source, e.g., when the light assembly is magnetically attached to body in a first orientation. In response to the light assembly being rotated to a different (second) orientation relative to the body, the electrically conductive surfaces of the body may no longer align with the electrical contact surfaces of the light assembly, resulting in the electrical circuit being broken, and a corresponding light source being deenergized.

Figure 11A:
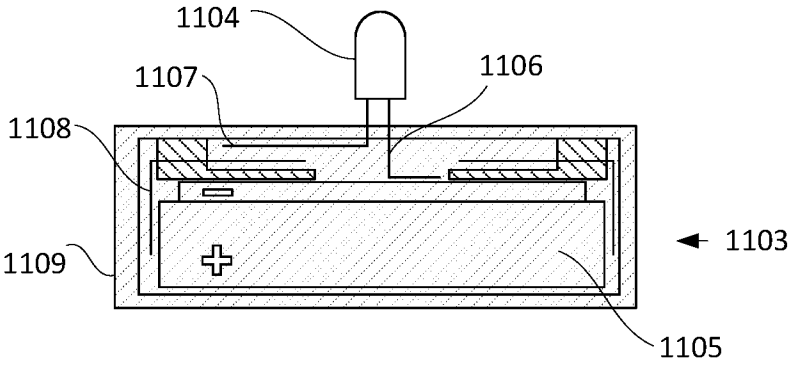
Figure 11B:
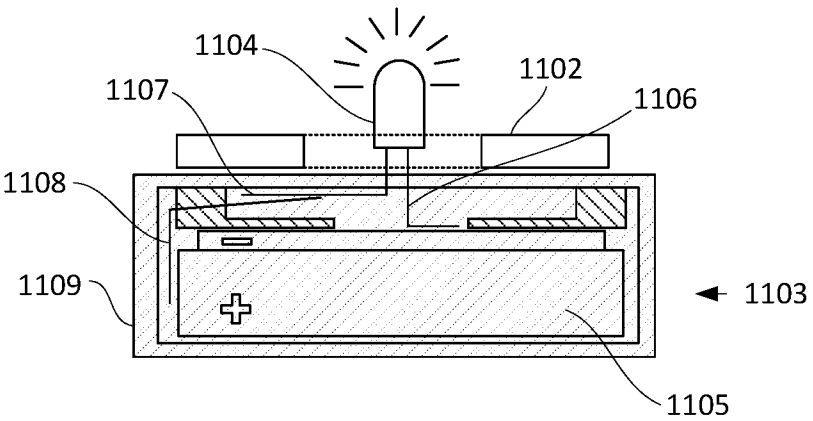

FIGS. 11A-11B and 12A-12B are diagrams illustrating various views of respective light assemblies and magnetic elements that include magnetically-attractive and movable electrical contacts. FIGS. 11A and 11B are diagrams illustrating cross-sectional views of a light assembly 1103 that includes an electrical terminal 1108 that includes a magnetically-attractive (movable) portion. In this example, the electrical terminal 1108 is internal to the light assembly 1103. As illustrated in FIGS. 11A and 11B, the light assembly 1103 also includes a light source 1104, and a power source 1105. A first terminal 1106 of the light source 1104 that is electrically connected to a first terminal of the power source 1105 (a negative battery terminal in this example), while a second terminal 1107 of the light source 1104 is routed along an interior of a housing 1109. As shown by FIGS. 11A and 11B, magnetically coupling the light assembly 1103 with the magnetic element 1102 causes a bias of the movable portion of the electrical terminal 1108 to be overcome, moving the electrical terminal 1108 from a circuit open position in FIG. 11A, to a circuit closed position in FIG. 11B, which energizes the light source 1104 of the light assembly 1103.

Figure 12A:
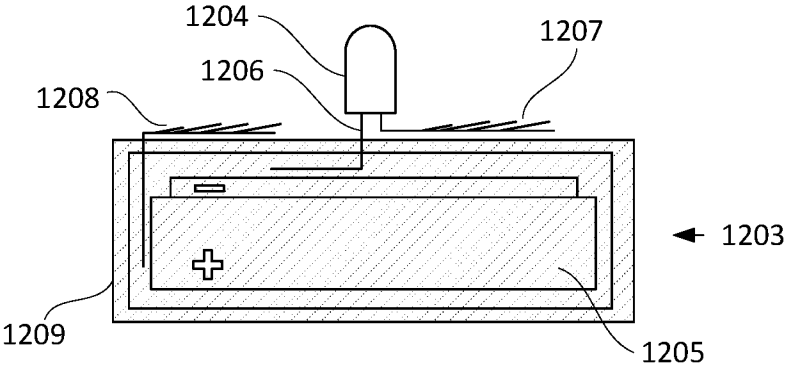
FIGS. 11A-11B and 12A-12B are diagrams illustrating various views of respective light assemblies and magnetic elements that include magnetically-attractive and movable electrical contacts.

FIG. 12A is a diagram illustrating a cross-sectional view of a light assembly 1203 that includes electrical terminals or contacts 1207 and 1208 that include magnetically-attractive (movable) portions that are external to the light assembly 1203, where the magnetically-attractive (movable) portions of the electrical terminals 1207 and 1208 are biased (normally) such that they are disposed on a surface of a housing 1209 of the light assembly 1203.

Figure 12B:
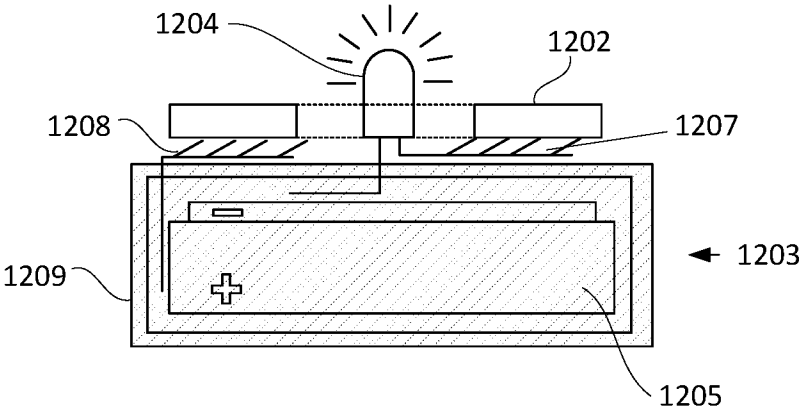

As illustrated in FIGS. 12A and 12B, the light assembly 1203 includes a light source 1204, and a power source 1205. A first terminal 1206 of the light source 1204 is electrically connected to a first terminal of the power source 1205 (a negative battery terminal in this example), while a second terminal of the light source 1204 is routed to an outer surface of a housing 1209 of the light assembly 1203, which includes the electrical terminal 1207.

Also in the light assembly 1203, the electrical terminal 1208 is electrically coupled with a second terminal of the power source 1205 (a positive battery terminal in this example). As shown in FIG. 12B, the magnetic connection with the magnetic element 1202 overcomes the bias of the movable portions of the electrical terminals 1207 and 1208, such that the electrical circuit of the light assembly 1203 is closed to energize the light source 1204. That is, the magnetic connection results in the movable portions of the electrical terminals 1207 and 1208 being in contact with the magnetic element 1202 to close the lighting circuit.

In a general aspect, an illumination assembly can include an article including a body having a first magnetic element, and at least one electrically conductive surface. The illumination assembly can also include a light assembly including, a housing, a second magnetic element, a light source, and a power source. A first terminal of the light source can be electrically coupled with a first terminal of the power source. The light assembly can further include a first electrical contact disposed on the housing and a second electrical contact disposed on the housing. The first electrical contact can be electrically coupled with a second terminal of the light source, and the second electrical contact can be electrically coupled with a second terminal of the power source. Magnetically coupling the light assembly with the article, via the first magnetic element and the second magnetic element, can electrically couple the first electrical contact with the second electrical contact, via the at least one conductive surface of the article, to energize the light source.

Implementations can include one or more of the following features. For example, the first magnetic element can be a magnet, and the second magnetic element can be a magnetically-attractive metal. The second magnetic element can be included in at least one of the housing, the power source, the first electrical contact, or the second electrical contact.

The light source can include a light emitting diode. The power source can include a battery. The light source can be a first light source, and the light assembly can further include a second light source coupled with the housing, and a third electrical contact disposed on the housing. A first terminal of the second light source can be electrically coupled with the first terminal of the power source. The third electrical contact can be electrically coupled with a second terminal of the second light source. Magnetically coupling the first magnetic element with the second magnetic element can further electrically couple, via the at least one conductive surface of the article, the third electrical contact with the first electrical contact and the second electrical contact to energize the second light source.

The at least one conductive surface can be configured such that rotating the light assembly relative to the article, while the light assembly is magnetically coupled with the article, selectively energizes and deenergizes the light source. The at least one conductive surface can include at least two conductive surfaces.

The light assembly can further include a reflective element configured to the direct light from the light source into the body of the article. The article can be, at least in part, transparent or translucent. The body of the article can include a stemware vessel.

The at least one conductive surface of the article can be included in the first magnetic element. The illumination assembly can include an electrically insulative material disposed on a portion of the at least one conductive surface. The electrically insulative material can be arranged on the least one conductive surface such that rotating the light assembly relative to the article, while the light assembly is magnetically coupled with the article, selectively energizes and deenergizes the light source.

The first magnetic element can include a ring-shaped magnet. The light source, while the light assembly is magnetically coupled with the article, can extend, at least partially, through an opening of the ring-shaped magnet.

In another general aspect, an illumination assembly can include an article including a body having a first magnetic element. The illumination assembly can further include a light assembly including a housing, a second magnetic element, and a light source coupled with the housing. A first terminal of the light source can be disposed within the housing. The light assembly can further include a power source disposed in the housing. A second terminal of the light source can be electrically coupled with a first terminal of the power source. The light assembly can also include a magnetically-attractive electrical terminal disposed within the housing. The magnetically-attractive electrical terminal can be normally biased such that it is spaced from the first terminal of the light source. The magnetically-attractive electrical terminal can be electrically coupled with a second terminal of the power source. The normal bias of the magnetically-attractive electrical contact can be overcome, such that the first terminal of the light source is electrically coupled with the magnetically-attractive electrical terminal to energize the light source, as a result of the light assembly being magnetically coupled with the article via the first magnetic element and the second magnetic element.

Implementations can include one or more of the following features. For example, the first magnetic element can be a magnet, and the second magnetic element can be a magnetically-attractive metal. The second magnetic element can be included in at least one of the housing, the power source, the first electrical contact, or the second electrical contact.

In another general aspect, an illumination assembly can include an article including a body, a first magnetic element included in, or coupled with the body, and at least one electrically conductive surface. The illumination assembly can further include a light assembly including a housing, a second magnetic element, a light source, and a power source disposed in the housing. A first terminal of the light source can be electrically coupled with a first terminal of the power source. The light assembly can further include a first electrical contact disposed on the housing, and a second electrical contact disposed on the housing. The first electrical contact can include a first magnetically-attractive movable portion and be electrically coupled with a second terminal of the light source. The second electrical contact can include a second magnetically-attractive movable portion and be electrically coupled with a second terminal of the power source. As a result of magnetically coupling the light assembly with the article via the first magnetic element and the second magnetic element, the first magnetically-attractive movable portion of the first electrical contact and the second magnetically-attractive movable portion of the second electrical contact can respectively move, such that the first electrical contact is electrically coupled with the second electrical contact via the at least one electrically conductive surface, and the light source is energized.

Implementations can include one or more of the following features. For example, the at least one conductive surface can be configured such that rotating the light assembly relative to the article, while the light assembly is magnetically coupled with the article, selectively energizes and deenergizes the light source. The at least one conductive surface can include at least two conductive surfaces. The at least one conductive surface of the article can be included in the first magnetic element.

The illumination assembly can further include an electrically insulative material disposed on a portion of the at least one conductive surface. The electrically insulative material can be arranged such that rotating the light assembly relative to the article, while the light assembly is magnetically coupled with the article, selectively energizes and deenergizes the light source.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the embodiments.

What is claimed is:

1. An apparatus comprising:

a housing;

a first light source having a first terminal and a second terminal;

a first power supply terminal electrically coupled with the first terminal of the first light source;

a first electrical contact disposed, at least in part, on an outer surface of the housing, the first electrical contact being electrically coupled with the second terminal of the first light source;

a second electrical contact disposed, at least in part, on the outer surface of the housing; and a second power supply terminal electrically coupled with the second electrical contact, wherein electrically coupling the first electrical contact with the second electrical contact electrically couples the second power supply terminal with the second terminal of the first light source to energize the first light source.

2. The apparatus of claim 1, further comprising:

a second light source having a first terminal and a second terminal, the first terminal of the second light source being electrically coupled with the first power supply terminal; and a third electrical contact disposed, at least in part, on the outer surface of the housing, the third electrical contact being electrically coupled with the second terminal of the second light source, wherein electrically coupling the third electrical contact with the second electrical contact electrically couples the second power supply terminal with the second terminal of the second light source to energize the second light source.

3. The apparatus of claim 2, wherein:

the first light source includes a first light emitting diode;

the second light source include a second light emitting diode;

the first power supply terminal is a first terminal of a battery; and the second power supply terminal is a second terminal of the battery.

4. The apparatus of claim 2, wherein electrically coupling the first electrical contact with the second electrical contact to energize the first light source, and electrically coupling the third electrical contact with the second electrical contact to energize the second light source, includes magnetically coupling the housing with a magnetic element having at least one conductive surface.

5. The apparatus of claim 4, wherein the at least one conductive surface includes at least two conductive surfaces.

6. The apparatus of claim 5, wherein changing a rotational position of the housing with respect to the magnetic element:

selectively activates and deactivates the first light source; and selectively activates and deactivates the second light source.

7. The apparatus of claim 5, wherein the magnetic element includes:

a first magnetic element including a first conductive surface of the at least two conductive surfaces; and a second magnetic element including a second conductive surface of the at least two conductive surfaces.

8. The apparatus of claim 2, further comprising:

a third light source having a first terminal and a second terminal, the first terminal of the third light source being electrically coupled with the first power supply terminal; and a fourth electrical contact disposed, at least in part, on the outer surface of the housing, the fourth electrical contact being electrically coupled with the second terminal of the third light source, wherein electrically coupling the fourth electrical contact with the second electrical contact electrically couples the second power supply terminal with the second terminal of the third light source to energize the third light source.

9. The apparatus of claim 8, wherein:

the first light source includes a red light emitting diode;

the second light source includes a green light emitting diode; and the third light source includes a blue light emitting diode.

10. The apparatus of claim 8, wherein:

the first power supply terminal is a first terminal of a battery; and the second power supply terminal is a second terminal of the battery.

11. The apparatus of claim 8, wherein electrically coupling the first electrical contact with the second electrical contact to energize the first light source, electrically coupling the third electrical contact with the second electrical contact to energize the second light source, and electrically coupling the fourth electrical contact with the second electrical contact to energize the third light source includes magnetically coupling the housing with a magnetic element having at least one conductive surface.

12. The apparatus of claim 11, wherein the at least one conductive surface includes at least three conductive surfaces.

13. The apparatus of claim 12, wherein rotating the housing with respect to the magnetic element:

selectively activates and deactivates the first light source;

selectively activates and deactivates the second light source; and selectively activates and deactivates the third light source.

14. An assembly comprising:

an article including:

a body having a first magnetic element; and at least one electrically conductive surface; and a light assembly including:

a housing;

a second magnetic element;

a light source;

a power source, a first terminal of the light source being electrically coupled with a first terminal of the power source;

a first electrical contact disposed, at least in part, on the housing, the first electrical contact being electrically coupled with a second terminal of the light source; and a second electrical contact disposed, at least in part, on the housing, the second electrical contact being electrically coupled with a second terminal of the power source, wherein:

magnetically coupling the light assembly with the article, via the first magnetic element and the second magnetic element, electrically couples the first electrical contact with the second electrical contact, via the at least one electrically conductive surface of the article, to energize the light source; and at least one of the first magnetic element and the second magnetic element includes a ring shaped magnetic element, the light source, while the light assembly is magnetically coupled with the article, extends, at least partially, through at least one of an opening of the first magnetic element, or through an opening of the second magnetic element.

15. The assembly of claim 14, wherein changing a rotational position of the light assembly relative to the article selectively energizes and deenergizes the light source.

16. The assembly of claim 14, wherein:

the first magnetic element is a magnet; and the second magnetic element is a magnetically-attractive metal.

17. The assembly of claim 14, wherein:

the first magnetic element is a magnetically-attractive metal; and the second magnetic element is a magnet.

18. The assembly of claim 14, wherein the at least one electrically conductive surface includes at least two electrically conductive surfaces.

19. The assembly of claim 14, wherein the at least one electrically conductive surface is disposed, at least in part, on a surface of the first magnetic element.

* * * * *